US006020096A

United States Patent [19]

Fuller et al.

[11] Patent Number: 6,020,096

[45] Date of Patent: Feb. 1, 2000

[54] CHARGE TRANSPORT LAYER AND PROCESS FOR FABRICATING THE LAYER

[75] Inventors: Timothy J. Fuller, Pittsford; Markus R. Silvestri; Damodar M. Pai, both of Fairport; John F. Yanus, Webster; Raymond K. Crandall, Pittsford; Samuel Kaplan, Walworth; Karen S. Garland, Palmyra, all of N.Y.

[73] Assignee: Xerox Corporation, Stamford, Conn.

[21] Appl. No.: 09/181,451

[22] Filed: Oct. 28, 1998

[51] Int. Cl.[7] ..... G03G 5/087

[52] U.S. Cl. ..... 430/58.35; 430/132

[58] Field of Search ..... 430/58.35, 127, 430/132

[56] References Cited

U.S. PATENT DOCUMENTS

| | | | |
|---|---|---|---|
| 4,265,990 | 5/1981 | Stolka et al. | 430/59 |
| 4,725,518 | 2/1988 | Carmichael et al. | 430/58 |
| 5,149,612 | 9/1992 | Langlois et al. | 430/132 |
| 5,356,741 | 10/1994 | Carmichael et al. | 430/56 |
| 5,863,685 | 1/1999 | DeFeo et al. | 430/132 |
| 5,882,831 | 3/1999 | Fuller et al. | 430/132 |

*Primary Examiner*—John Goodrow

[57] ABSTRACT

An electrophotographic imaging member comprising a charge generating layer comprising trigonal selenium particles and a charge transport layer, the charge transport layer including a protonic acid or Lewis acid, a charge transporting small molecule, a film forming polymer, and polyalkylene-block-polyethylene oxide.

This imaging member may be fabricated using a suitable solvent for applying the charge transport layer.

15 Claims, No Drawings

CHARGE TRANSPORT LAYER AND PROCESS FOR FABRICATING THE LAYER

BACKGROUND OF THE INVENTION

This invention relates in general to electrophotographic imaging members and more specifically, to imaging members having an improved acid doped charge transport layer and process for fabricating the imaging members.

In the art of electrophotography an electrophotographic plate comprising a photoconductive insulating layer on a conductive layer is imaged by first uniformly electrostatically charging the imaging surface of the photoconductive insulating layer. The plate or photoreceptor is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided toner particles on the surface of the photoconductive insulating layer. The resulting visible toner image can be transferred to a suitable receiving member such as paper. This imaging process may be repeated many times with reusable photoconductive insulating layers.

One common type of photoreceptor is a multilayered device that comprises a conductive layer, a charge generating layer, and a charge transport layer. Either the charge generating layer or the charge transport layer may be located adjacent the conductive layer. The charge transport layer can contain an active aromatic diamine small molecule charge transport compound dissolved or molecularly dispersed in a film forming binder. This type of charge transport layer is described, for example in U.S. Pat. No. 4,265,990. Although excellent toner images may be obtained with such multilayered photoreceptors, it has been found that acid doping of the charge transport layer enhanced predictability of performance for high precision copiers, duplicators and printers having narrow sensitivity windows. This acid doping is described, for example in U.S. Pat. No. 4,725,518, U.S. Pat. No. 5,149,612 and U.S. Pat. No. 5,356,741, the entire disclosures of these patents being incorporated herein by reference. This acid doping overcame the unpredictable variations in electrical performance of photoreceptors made from commercially available methylene chloride and polycarbonate that contained impurities that fluctuated from batch to batch and from the batch to batch variabilities of the generator layer pigment. Acid doping is preferably accomplished by combining transport layer solutions from two different pots (one doped with a very low amount of acid and the second doped with a higher concentration of acid) are mixed just prior to the introduction of the coating solution into the coating die. The amount of material from the second pot is adjusted continuously to bring electrical characteristics to the desired level. Surprisingly, with the passage of time, the optimum amount of acid used for doping diminished to about 3 ppm based on the weight of methylene chloride, due, probably, to unknown material and/or process changes pertaining to synthesis of the commercially available methylene chloride solvent and/or other components in the charge transport layer such as the polycarbonate film forming binder.

As doping was reduced to lower levels, the resulting photoreceptors began to exhibit "edge spikes" in which some regions of the photoreceptors have higher background potential (lower sensitivities) resulting in dark background print out in these regions. The loss in sensitivity along the edges occurs in a periodic pattern. The edge spike becomes less prominent if the doping acid, such as trifluoroacetic acid (TFA), concentration is increased to more than about 10 ppm, based on the weight of methylene chloride. However, when the concentration of TFA is increased to more than about 20 ppm in the photoreceptors, the photoreceptors show increased depletion, higher dark decay and long term cyclic instability.

Thus it is desirable to have a quality control tool such as acid doping that can be varied during the manufacturing and yet have the acid concentration stay between about 5 and about 15 ppm based on the weight of methylene chloride.

INFORMATION DISCLOSURE STATEMENT

U.S. Pat. No. 4,725,518 to Carmichael et al., issued Feb. 16, 1988—A process for preparing an electrophotographic imaging member is disclosed comprising providing a photogenerating layer on a supporting substrate and applying a charge transport layer forming mixture to the photogenerating layer, the charge transport layer forming mixture comprising a charge transporting aromatic amine compound of one or more compounds having certain specified general formula, a polymeric film forming resin in which the aromatic amine is soluble, solvent for the polymeric film forming resin, and from about 1 part per million to about 10,000 parts per million, based on the weight of the aromatic amine, of a protonic acid or Lewis acid having a boiling point greater than about 40° C. and soluble in the solvent.

U.S. Pat. No. 5,149,612 to Langlois et al., issued Sep. 22, 1992—Processes and apparatus for fabricating an electrophotographic imaging member are disclosed in which a web coated with a charge generation layer is coated with a charge transport layer comprising a dopant, the improvement comprising detecting the change in dopant concentration required, determining the amount of highly doped charge transport composition and amount of undoped or lowly doped charge transport composition required to achieve the change in dopant concentration, feeding the determined amounts of highly doped charge transport composition and undoped or lowly doped charge transport composition into a mixing zone, rapidly mixing the amounts of highly doped charge transport composition and undoped or lowly doped charge transport composition to form a uniformly doped charge transport composition, and applying the uniformly doped charge transport composition to the charge generation layer.

U.S. Pat. No. 5,356,741 to Carmichael et al., issued Oct. 18, 1994—A method of controlling variations in electrical characteristics in electrophotographic imaging devices by eliminating the effect of acidic or basic impurities in a photoconductive element. A solution of a weak acid or weak base and a conjugate salt of the weak acid and the weak base is incorporated into a layer of the photoconductive element. In a process for producing the photoconductive element, a substrate is coated with a first dispersion to form a charge generating layer, and then coated with a second dispersion to form a charge transporting layer, wherein there is incorporated in at least one of the first and second dispersions a solution of a weak acid or weak base and the conjugate salt of the weak acid and weak base in an amount effective to reduce variations in the dark development potential ($V_{DDP}$) and background potential ($V_{BG}$) characteristics of the imaging devices.

U.S. Pat. No. 4,265,990, issued to Stolka et al. on May 5, 1981—A photosensitive member is disclosed having photoconductive layer and a charge transport layer, the charge transport layer containing an aromatic diamine in an inactive film forming binder.

CROSS REFERENCE TO COPENDING APPLICATIONS

U.S. patent application Ser. No. 09/181,625 now U.S. Pat. No. 5,882,831, filed concurrently herewith, in the names of Fuller et al., entitled "ACID DOPING LATITUDE ENLARGEMENT FOR PHOTORECEPTORS" (Attorney Docket No. 97675)—An electrophotographic imaging member is disclosed comprising a charge generating layer and a charge transport layer, the charge transport layer including a protonic acid or Lewis acid a charge transporting small molecule, a film forming polymer, and an additive selected from the group consisting of 1-alkylpiperidene, triethylamine, a complex of 1-alkylpiperidene and a protonic acid or Lewis acid, a complex of triethylamine and a protonic acid or Lewis acid and mixtures thereof.

This imaging member may be fabricated using a solvent for applying the charge transport layer.

Additives such as 1-ethyl piperidine and poly(alkylene)-block-poly(ethylene oxide) raise the background potential in volts, which is then brought back down with trifluoroacetic acid (and the like) with the added bonus of decreased dark decay and reduced depletion. Sensitivity may or may not be affected.

Excellent toner images may be obtained with multilayered photoreceptors having acid doped charge transport layers with acid concentration in the range of 5 to 15 ppm based on the weight of methylene chloride. However, it has been found that the sensitivity of the device increases with the acid concentration with the highest rate of change of sensitivity occurring in the range of 0 to 5 ppm acid and the rate slowing down beyond 5 ppm. In the manufacturing process, if the acid concentration required to be within a predetermined sensitivity level is less than 5 ppm acid, any non-uniformity in the mixing of the transport layer results in sensitivity variations along the width of the photoreceptor. When the acid doping concentration is higher than 5 ppm, the variation of sensitivity with acid is not as pronounced and non uniform mixing of the transport layer gives rise to only small variabilities in the sensitivity along the width of the photoreceptor. This results in more rejects which in turn decreases the yield when the acid doping concentration is less than 5 ppm. Furthermore when such a photoreceptor is cycled in a xerographic machine, edge spikes occur thereby creating unacceptable images.

Thus, there is a continuing need for electrophotographic imaging members having improved electrical characteristics.

BRIEF SUMMARY OF THE INVENTION

It is, therefore, an object of the present invention to provide an improved electrophotographic imaging member which overcomes the above-noted disadvantages.

It is another object of the present invention to provide an electrophotographic imaging member which avoids edge spikes.

It is still another object of the present invention to provide an electrophotographic imaging member which contains higher proportions of doping acid.

It is another object of the present invention to provide an electrophotographic imaging member that exhibits improved latitude for methylene chloride purity fluctuations.

It is still another object of the present invention to provide an electrophotographic imaging member that exhibiting greater latitude for polycarbonate purity fluctuations.

It is yet object of the present invention to provide an electrophotographic imaging member possessing improved latitude for transport layer materials.

It is still another object of the present invention to provide an electrophotographic imaging member that exhibiting greater latitude for polycarbonate purity.

It is another object of the present invention to provide for a device and a process that provides for greater latitude for photogenerator pigment batches.

It is still another object of the present invention to provide photoreceptor devices which perform without edge spike deletions, cycle-up and other deleterious electrical or print-out problems.

The foregoing objects and others are accomplished in accordance with this invention by providing an electrophotographic imaging member comprising a charge generating layer comprising trigonal selenium particles and a charge transport layer, the charge transport layer comprising a protonic acid or Lewis acid, a charge transporting small molecule, a film forming polymer, and polyalkylene-block-polyethylene oxide.

This imaging member may be fabricated using a suitable solvent for applying the charge transport layer.

Electrostatographic imaging members are well known in the art. Electrostatographic imaging members may be prepared by various suitable techniques. Typically, a flexible or rigid substrate is provided having an electrically conductive surface. A charge generating layer is then applied to the electrically conductive surface. A charge blocking layer may be applied to the electrically conductive surface prior to the application of the charge generating layer. If desired, an adhesive layer may be utilized between the charge blocking layer and the charge generating layer. Usually the charge generation layer is applied onto the blocking layer and a charge transport layer is formed on the charge generation layer. However, in some embodiments, the charge transport layer is applied prior to the charge generation layer.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. The electrically insulating or conductive substrate may be in the form of an endless flexible belt, a web, a rigid cylinder, a sheet and the like.

The thickness of the substrate layer depends on numerous factors, including strength desired and economical considerations. Thus, this layer for a flexible belt may be of substantial thickness, for example, about 125 micrometers, or of minimum thickness less than 50 micrometers, provided there are no adverse effects on the final electrostatographic device.

The conductive layer may vary in thickness over substantially wide ranges depending on the optical transparency and degree of flexibility desired for the electrostatographic member. Accordingly, for a flexible photoresponsive imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. In general, a continuous metal film can be attained on a suitable substrate, e.g. a polyester web substrate such as Mylar available from E. I. du Pont de Nemours & Co. with magnetron sputtering.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof.

After formation of an electrically conductive surface, a hole blocking layer may be applied thereto for photoreceptors. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino) titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,338,387, 4,286,033 and 4,291,110. The disclosures of U.S. Pat. Nos. 4,338,387, 4,286,033 and 4,291,110 are incorporated herein by reference in their entirety. A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and have a thickness of less than about 0.2 micrometer because greater thicknesses may lead to undesirably high residual voltage.

An optional adhesive layer may applied to the hole blocking layer. Any suitable adhesive layer well known in the art may be utilized. Typical adhesive layer materials include, for example, polyesters, duPont 49,000 (available from E. I. duPont de Nemours and Company), Vitel PE100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer comprising trigonal selenium particles dispersed in a film forming polymeric binder may be applied to the adhesive blocking layer which can then be overcoated with a contiguous hole transport layer as described hereinafter. and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating trigonal selenium particles are present in the resinous binder composition in various amounts, generally, however, from about 5 percent by volume to about 90 percent by volume of the photogenerating trigonal selenium particles is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition. Preferably, the trigonal particles have an average particle size of less than about 0.1 micrometer.

The photogenerating layer generally ranges in thickness of from about 0.1 micrometer to about 5.0 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

The active charge transport layer of this invention comprises a charge generating layer and a charge transport layer, the charge transport layer comprising a protonic acid or Lewis acid, a charge transporting small molecule, a film forming polymer, and polyalkylene-block-polyethylene oxide.

The charge transporting small molecule is dissolved or molecularly dispersed in the film forming polymer. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale.

Any suitable charge transporting or electrically active arylamine small molecule may be employed in the charge transport layer of this invention. The expression charge transporting "small molecule" is defined herein as a monomer that allows the free charge photogenerated in the transport layer to be transported across the transport layer. Typical arylamine charge transporting small molecules include, for example, pyrazolines such as 1-phenyl-3-(4'-diethylamino styryl)-5-(4"-diethylamino phenyl) pyrazoline, diamines such as N,N'-diphenyl-N,N'-bis(3-methylphenyl)-(1,1-biphenyl)-4,4'-diamine, hydrazones such as N-phenyl-N-methyl-3-(9-ethyl) carbazyl hydrazone and r-diethyl amino benzaldehyde-1,2-diphenyl hydrazone, and oxadiazoles such as 2,5-bis (4-N,N'-diethylaminophenyl)- 1,2,4-oxadiazole, stilbenes and the like. However, to avoid cycle-up, the charge transport layer should be substantially free of triphenyl methane. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-di-amine.

Still other examples of electrically active small molecule charge transporting compounds include aromatic amine compounds represented by the following general formula:

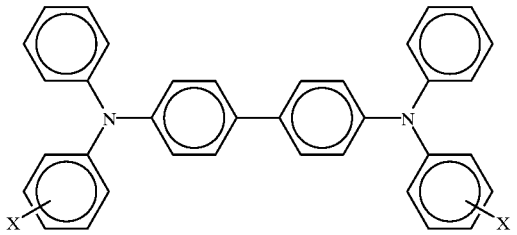

wherein X is selected from the group consisting of an alkyl group containing from 1 to 4 carbon atoms and chlorine. Examples of small molecule charge transporting aromatic amines represented by the structural formula above capable of supporting the injection of photogenerated holes and transporting the holes through the charge transport layer include N,N'-diphenyl-N,N'-bis(alkylphenyl)-(1,1'-biphenyl)-4,4'-diamine wherein the alkyl is, for example, methyl, ethyl, propyl, n-butyl, and the like, N,N'-diphenyl-N,N'-bis(chlorophenyl)-[1,1'-biphenyl]-4,4'-diamine, N,N'-diphenyl-N,N'-bis(3-methylphenyl)-(1,1'-biphenyl)-4,4'-diamine, and the like. The specific aromatic diamine charge transport layer compound illustrated in the formula above is described in U.S. Pat. No. 4,265,990, the entire disclosure thereof being incorporated herein by reference. Still other examples of aromatic diamine small molecule charge transport layer compounds include N,N,N',N'-tetraphenyl-[3,3'-dimethyl-1,1'-biphenyl]-4,4'-diamine; N,N'-diphenyl-N,N'-bis(2-methylphenyl)-[3,3'-dimethyl- 1,1'-biphenyl]-4,4'-diamine; N,N'-diphenyl-N,N'-bis(3-methylphenyl)-[3,3'-dimethyl-1,1 '-biphenyl]-4,4'- diamine; N,N'-diphenyl-N,N'-bis(4-methylphenyl)-[3,3'dimethyl-1,1'-biphenyl]-4,4'-diamine; N,N,N',N'-tetra(2-methylphenyl)-[3,3'-dimethyl-1,1'-biphenyl]-4,4'-diamine; N,N'-bis(2-methylphenyl)-N,N'-bis(4-methylphenyl)-[3,3'-dimethyl-1,1'-biphenyl]-4,4'-diamine; N,N'-bis(3-methylphenyl)-N,N'-bis(2-methylphenyl)-[3,3'-dimethyl-1,1'-biphenyl]-4,4'-diamine; N,N,N',N'-tetra(3-methylphenyl)-[3,3'-dimethyl-1,1'-biphenyl]-4,4'-diamine; N,N'-bis(3-methylphenyl)-N,N'-bis (4-methylphenyl)-[3,3'-dimethyl-1,1'-biphenyl]-4,4'-diamine; and N,N,N',N'-tetra(4-methylphenyl)-[3,3'-dimethyl-1,1'-biphenyl]-4,4'-diamine. The aromatic diamine small molecule charge transport layer compounds illustrated above are described in U.S. Pat. No. 4,299,897, the entire disclosure thereof being incorporated herein by reference. Additional examples of small molecule charge transporting compounds include: N,N,N',N'-Tetra-(4-methylphenyl)-[3,3'-dimethyl-1,1'-biphenyl]-4,4'-diamine; N,N'-diphenyl-N,N'-bis(4-methylphenyl)-[3,3'-dimethyl-1,1'-biphenyl]-4,4'-diamine; and N,N'-bis(4-methylphenyl)-N,N'-bis(4-ethylphenyl)-[3,3'-dimethyl-1,1'-biphenyl]-4,4'-diamine. The second of these two specific small molecule aromatic diamine charge transport layer compounds is described in U.S. Pat. No. 4,299,897, the entire disclosure thereof being incorporated herein by reference. The substituents on both the first and second types of aromatic diamine molecules should be free from electron withdrawing groups such as $NO_2$ groups, CN groups, and the like. Other typical arylamine small molecules are described in U.S. Pat. No. 4,725,518, the entire disclosure thereof being incorporated herein by reference.

Preferably, the dried charge transport layer comprises between about 30 and about 60 percent by weight of the small molecule charge transporting compound, based on the total weight of the dried charge transport layer.

Any suitable electrically inert film forming polymeric binder may be used to disperse the electrically active molecule in the charge transport layer. Typical inert polymeric binders include, for example, poly (4,4'-isopropylidene-diphenylene) carbonate (also referred to as bisphenol-A-polycarbonate), poly (4,4'-isopropylidene-diphenylene) carbonate, poly (4,4'-diphenyl-1,1'-cyclohexane carbonate), and the like. Other typical inactive resin binders include polyaryl ketones, polyester, polyarylate, polyacrylate, polyether, polysulfone, and the like. Weight average molecular weights can vary, for example, from about 20,000 to about 150,000. However, weight average molecular waits outside this range may be utilized where suitable. The film forming binders and other components utilized in the charge transport layer should be soluble in the solvent utilized to apply the charge transport layer coatings.

Preferably, the dried charge transport layer comprises between about 40 and about 70 percent by weight of the film forming polymer, based on the total weight of the dried charge transport layer.

Any suitable solvent may be used for the charge transport coating mixture. Typical solvents include, for example, methylene chloride, tetrahydrofuran, toluene and monochloro benzene, and the like. The solvent selected should dissolve all of the components used to form the charge transport layer. A preferred solvent is methylene chloride. Generally, the amount of solvent used depends upon the type of coating technique employed. For example, less solvent is used for dip or immersion coating than for extrusion coating. Typically, depending upon the coating process selected, the amount of solvent ranges from about 70 percent by weight to about 90 percent by weight based on the total weight of the coating mixture.

Any suitable polyalkylene-block-polyethylene oxide dopant or additive may be utilized in the charge transport layer of the photoreceptor of this invention. The polyalkylene segment may be polymethylene, polyethylene, polypropylene, polybutylene, polyisobutylene, hydrogenated polybutadienes, and the like. Exemplary polyalkylene-block-polyethylene oxide polymers are represented by the formula:

$$A—B \quad (I)$$

wherein A is the unit:

$$CH_3(CH\overset{R}{\overset{|}{C}}H\overset{R_1}{\overset{|}{C}}H)_x— \quad (IA)$$

and R and $R_1$ individually represent hydrogen or the same or different lower alkyl groups of from 1 to about 10 carbon atoms; and x represents a number of from about 1 to about 142 and preferably from about 11 to about 70; and further wherein B is the unit:

$$—CH_2O(CH_2\overset{R_2}{\overset{|}{C}}HO)_YH \quad (IB)$$

and $R_2$ represents hydrogen or a $C_1$–$C_5$ alkyl group; y represents the average number of oxyalkylene groups present in the molecule and is a number of from about 2 to about 817, and preferably about 3 to about 408, most preferably from about 3 to about 204. In addition, the weight ratio of B/A+B in formula (I) is between about 51 to about 90 percent, preferably about 75 to about 85 percent, most preferably 80 percent. The average molecular weight of the polyalkylene-block-polyethylene oxide polymers may range from about 250 to about 5,000, preferably no greater than about 1,000. The precursor of the unit represented by formula (IA) normally has a molecular weight between about 250 to about 5,000, preferably about 350 to about 2,000, and more preferably between about 425 to about 1,000. Preferred polyalkylene-block-polyethylene oxide additives or dopants for the charge transport layer of this invention are those represented by formula (1) above wherein R and $R_1$ are independently selected from the group consisting of —H and $C_1$–$C_3$ alkyl and $R_2$ is —H or a $C_1$–$C_3$ alkyl group. Most preferred are those compounds wherein R, $R_1$ and $R_2$ are independently hydrogen or a methyl group, especially those represented by the formulae:

$$CH_3(CH_2CH_2)_xCH_2O(CH_2CH_2O)_yH \quad (IIA)$$

and $$CH_3(CH_2CH_2)_xCH_2O(CH_2\underset{\underset{CH_3}{|}}{C}HO)_yH \quad (IIB)$$

as well as mixtures thereof. As an alternative, the compound may be of formula (I) above where $R_2$ is randomly selected from the substituents —H and —$CH_3$. The average molecular weight (Mn) of the polymers of Formula (IIA) and (IIB) are most preferably about 700 to about 5,000.

An especially preferred polyalkylene-block-polyethylene oxide includes Unithox 420 which consists of about 80 weight percent of units represented by formula (IA) above and 20 weight percent of units of formula (IB) above wherein R, $R_1$ and $R_2$ are all hydrogen and wherein the AB polymer has a melting point of about 91° C. and a number average molecular weight between about 400 and 550. Unithox® 520 is similar to Unithox® 420, but has a number average molecular weight of about 690 and melting point of about 99° C. Other commercially available polyalkylene-block-polyethylene oxide compounds include, for example, Unithox® 720 having a melting point of about 106° C. and a number average molecular weight of about 875. The preferred polyalkylene-block-polyethylene oxide compounds typically average 24 to 45 carbon atoms (on a weight basis), preferably 28 to 42 carbon atoms and most preferably 30 to 40 carbon atoms. These polyalkylene-block-polyethylene oxide compounds are described in U.S. Pat. No. 5,441,998, U.S. Pat. No. 5,414,039 and U.S. Pat. No. 5,391,601, the entire disclosures of these patents being incorporated herein by reference.

Satisfactory results are achieved when the charge transport layer comprises at least about 10 ppm polyalkylene-block-polyethylene oxide, based on the weight of the film forming polymer. Preferably, the charge transport layer comprises between about 10 ppm and about 150 ppm by weight of polyalkylene-block-polyethylene oxide, based on the weight of the film forming polymer. When the charge transport layer comprises less than about 10 ppm polyalkylene-block-polyethylene oxide, there is no significant change in the TFA concentration required to meet the sensitivity target and therefore this results in unacceptable variation of image potential along the width of the photoreceptor due to inadequate mixing of the transport layer coating solution. This results in edge spike printout problems. If the charge transport layer comprises more than about 150 ppm polyalkylene-block-polyethylene oxide, the TFA concentration required to bring the image potential to acceptable levels increases considerably and the resulting device shows cyclic instability known as cycle-up (increase in residual potential with cycling. The polyalkylene-block-polyethylene oxide preferably forms turbid micellar solutions in the solvents utilized to fabricate the charge transport layer. The expression "turbid micellar solutions" are emulsions at high solids, but are clear and essentially transparent at high dilutions, and as employed herein, is defined as emulsions, the micelles having an average size of between about 0.01 nm and about 1 micrometer. A high solids emulsion of the diblock polymer scatters light whereas a dilute emulsion is essentially transparent so there is no extraneous absorption of light by the photoreceptor charge transport layer. Any suitable organic solvent may be utilized. Typical solvents include, for example, methylene chloride, tetrahydrofuran, monochlorobenzene, and other organic and halogenated organic solvents.

Surprisingly, related compounds such as polyethylene oxide and surfactants based on polyethylene oxide such as Triton X-405 and the like cause degradation of the photoreceptor and are undesirable as additives. Polyethylene oxide causes severe cycle-up at concentrations of about 1 ppm, based on the weight of the film forming polymer. Polycarbonate-block-polyethylene oxide-block-polycarbonate does not enhance acid doping latitude and may cause cycle up at concentrations of more than 20 ppm, based on the weight of the film forming polymer.

Any suitable stable protonic acid or Lewis acid or mixture thereof soluble in methylene chloride or other suitable solvent may be employed as a dopant in the transport layer of this invention to control dark decay and background potential. Stable protonic acids and Lewis acids do not decompose or form a gas at the temperatures and conditions employed in the preparation and use of the final multilayer photoconductor. Thus, protonic acids and Lewis acids having a boiling point greater than about 40° C. are especially preferred for greater stability during storage, transportation and operating conditions. Protonic acids generally are acids in which a proton ($H^+$) is available. Organic protonic acids include, for example, those having the following structural formulae:

$R_5$—COOH wherein $R_5$ is H or a substituted or unsubstituted alkyl group containing from 1 to 12 carbon atoms;

$R_6$—$SO_3H$ wherein $R_6$ is substituted or unsubstituted alkyl or aryl group containing from 1 to 18 carbon atoms;

$R_7$—COOH wherein $R_7$ is a substituted or unsubstituted cycloaliphatic or cycloaliphatic-aromatic group containing from 4 to 12 carbon atoms;

$R_8$—$SO_2H$ wherein $R_8$ is a substituted or unsubstituted alkyl, aryl, cycloalkyl group containing from 1 to about 12 carbon atoms; and

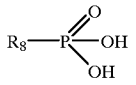

Typical organic protonic acids represented by these formulas having a boiling point greater than about 40° C. and that are soluble in methylene chloride or other suitable solvent include trifluoroacetic acid, trichloroacetic acid, methane sulfonic acid, acetic acid, nitrobenzoic acid, benzene-sulfonic acid, benzene-phosphonic acid, trifluoro methane sulfonic acid, and the like and mixtures thereof. Optimum results are achieved with trifluoroacetic acid and trichloroacetic acid because of good solubility, acid strength and in case of $CF_3COOH$ good chemical stability. Inorganic protonic acids include halogen, sulfur, selenium tellurium or phosphorous containing inorganic acids. Typical inorganic protonic acids include $H_2SO_4$, $H_3PO_4$, $H_2SeO_3$, $H_2SeO4$. Other less preferred inorganic protonic acids having boiling point less than 40° C. include HCl, HBr, HI, and the like and mixtures thereof.

Lewis acids generally are electron acceptor acids which can combine with another molecule or ion by forming a covalent chemical bond with two electrons from the second molecule or ion. Typical Lewis acids include aluminum trichloride, ferric trichloride, stannic tetrachloride, boron trifluoride, $ZnCl_2$, TiCl4, $SbCl_5$, $CuCl_2$, $SbF_5$, $VCl_4$, $TaCl_5$, $ZrCl_4$, and the like and mixtures thereof. The protonic acids and Lewis acids should preferably have a boiling point greater than about 40° C. to avoid loss of the acid dopant during preparation, storage, transportation or use at higher temperatures. Acids of lower boiling points than 40° C. may be used where practical. These protonic acids and Lewis acids are described in U.S. Pat. No. 4,725,518, the entire disclosure thereof being incorporated herein by reference.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be affected by any suitable conventional technique such as oven drying, infra red radiation drying, air drying and the like.

Generally, the dry thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers is preferably maintained from about 2:1 to 200:1 and in some instances as great as 400:1. In other words, the charge transport layer is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

The photoreceptors of this invention may comprise, for example, a charge generator layer sandwiched between a conductive surface and a charge transport layer as described above or a charge transport layer sandwiched between a conductive surface and a charge generator layer. This structure may be imaged in the conventional xerographic manner which usually includes charging, optical exposure and development.

Other layers may also be used such as conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are 10 well known and usually comprise conductive particles dispersed in a film forming binder.

Optionally, an overcoat layer may also be utilized to improve resistance to abrasion. In some cases an anti-curl back coating may be applied to the side opposite the photoreceptor to provide flatness and/or abrasion resistance. These overcoating and anti- curl back coating layers are well known in the art and may comprise thermoplastic organic polymers or inorganic polymers that are electrically insulating or slightly semi-conductive. Overcoatings are continuous and generally have a thickness of less than about 10 micrometers.

PREFERRED EMBODIMENT OF THE INVENTION

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

Several photoreceptors were prepared by forming coatings using conventional techniques on a substrate comprising a vacuum deposited titanium-zirconium layer on a polyethylene terephthalate film (Melinex®, available from E. I. duPont Nemours & Co.). The first coating was a siloxane barrier layer formed from hydrolyzed gamma aminopropyltriethoxysilane having a dry thickness of 100 angstroms. The second coating was an adhesive layer of polyester resin (49,000, available from E. I. duPont de Nemours & Co.) having a dry thickness of 50 angstroms. The next coating was a charge generator layer coated from a solution containing 0.8 gram trigonal selenium having a particle size of about 0.05 micrometer to 0.2 micrometer and about 0.8 gram poly(N-vinyl carbazole) in about 7 millimeters of tetrahydrofuran and about 7 milliliters cyclohexanone. The generator layer coating was applied with a 0.005 inch Bird applicator and the layer was dried at about 135° C. in a forced air oven for 5 minutes to form a layer having a 1.6 micrometer thickness.

EXAMPLE II

Five of the photogenerator layers of trigonal selenium of Example I were coated with a transport layer consisting of 50 weight percent N,N'-diphenyl-N,N'-bis(3-methylphenyl)-(1,1'biphenyl)-4,4'-diamine and 50 weight percent of batch 1 of polycarbonate resin [a poly (4,4'-isopropylidene-diphenylene) carbonate (Makrolon®, available from Farbenfabricken Bayer A. G.)] and 10 parts per million (ppm) of trifluoroacetic acid based on the weight of solvent and X ppm of Unithox 420 (U420) based on the weight of resin (or film forming polymer) in methylene chloride solvent. Unithox 420 is a commercially available polyethylene-block-polyethylene oxide from Petrolite Corporation (Tulsa, Okla.) made by anionic polymerization. The coated devices were heated in an oven maintained at from 40° C. to 100° C. over 30 minutes to form a charge transport layer having a thickness of 25 micrometers. Table A describes the electrical properties of the coated devices. Ten kilocycles cycling of the devices in a scanner did not record any cycle-up either in the control device (without U420) or samples doped with U420. Table A shows the increase in background with U420 doping . This would enable TFA doping concentration to be increased to bring the background back down again thereby increasing the TFA doping latitude.

TABLE A

Doping of Unithox 420 (U420) into Batch 1.

| Doping X of U420 [ppm] | Background at 3.8 ergs/cm$^2$ [Volts] | Depletion [Volts] | One second Dark Decay [Volts/sec] |
|---|---|---|---|
| 0 (Control #1) | 110 | −174 | 271 |
| 20 | 80 | −177 | 286 |
| 40 | 118 | −163 | 232 |
| 80 | 116 | −74 | 214 |
| 0 | 107 | −114 | 267 |

TABLE A-continued

Doping of Unithox 420 (U420) into Batch 1.

| Doping X of U420 [ppm] | Background at 3.8 ergs/cm$^2$ [Volts] | Depletion [Volts] | One second Dark Decay [Volts/sec] |
|---|---|---|---|
| (Control #2) | | | |
| 120 | 150 | −30 | 185 |
| 160 | 145 | −27 | 183 |

All numbers in Table A are absolute values.

Doping of U420 in parts per million (ppm) is based on the total weight of film forming polymer.

The second column is the potential after exposure of 3.8 ergs/cm$^2$.

Depletion in the third column represents loss of potential during the charging step and is caused by free carriers from the pigment traversing the charge transport layer during the charging the step.

In the fourth column V/s represents Volts/SEC and 1 s stands for one second.

Except for 20 ppm doping, all numerical values in Table A indicate an improvement. Doping levels at 20, 40, and 80 ppm were scanned with Control #1 and doping levels at 120 ppm and 160 ppm were scanned with Control 2. The control devices were not doped with U420.

Typically, 1 gram of trifluoroacetic acid (density 1.48 g/cc) is diluted to 100 grams with methylene chloride (density 1.325 g/cm) and 10 microLiter ($\mu$L) of this solution are added to a solution of 1.2 grams of Makrolon polycarbonate and 1,2 grams diamine in 13.45 grams methylene chloride. [(10 $\mu$L)(1 g TFA/100 g $CH_2Cl_2$) (1 Liter/$10^6$ $\mu$L)(1000 cc/Liter)(1.325 g/cc)×$10^6$ ppm[/]13.45 g]=about 10 ppm TFA per gram of solvent.

For the poly(alkylene-block-polyethylene oxide) doping level, 0.1 gram of block copolymer and then 10 $\mu$L of this solution are added to a solution of 1.2 grams Makrolon polycarbonate (Bayer) and 1.2 grams diamine in 13.45 grams of methylene chloride.

[10 $\mu$L (0.1 g copolymer/100 g $CH_2Cl_2$)(1 Liter/$10^6$ $\mu$L) (1000 cc/Liter)(1.325 g/cc)×x $10^6$ ppm]/1.2 g Makrolon)=10 ppm based on resin.

EXAMPLE III

Four of the photogenerator layers of trigonal selenium of Example I were coated with a transport layer consisting of 50 weight percent N,N'-diphenyl-N,N'-bis(3-methylphenyl)-(1,1'biphenyl)-4,4'-diamine and 50 weight percent of Batch 2 of polycarbonate resin [a poly (4,4'-isopropylidene-diphenylene) carbonate (Makrolon®, available from Farbenfabricken Bayer A. G.)] and 10 parts per million of trifluoroacetic acid and X ppm of Unithox 420 (U420) in methylene chloride solvent. Unithox 420 is a commercially available polyethylene-block-polyethylene oxide from Petrolite made by anionic polymerization. The coated devices were heated in an oven maintained at from 40° C. to 100° C. over 30 minutes to form a charge transport layer having a thickness of 25 micrometers. Table B describes the electrical properties. Ten kilocycles cycling in a scanner did not record any cycle-up either in the control device (without U420) or samples doped with U420. Table B shows the increase in background with U420 doping. This enables the TFA doping concentration to be increased to bring the background back down again thereby increasing the TFA doping latitude. The TFA doping latitude is higher for Batch 2.

TABLE B

Doping of Unithox 420 (U420) into Batch 2.

| Doping X of U420 [ppm] | Background at 3.8 ergs/cm$^2$ [Volts] | Depletion [Volts] | One second Dark Decay [Volts/sec] |
|---|---|---|---|
| 0 (Control #3) | 113 | −152 | 226 |
| 80 | 159 | −31 | 195 |
| 160 | 183 | +33 | 182 |

All numbers in Table B are absolute values.

Doping of U420 in parts per million (ppm) is based on the total weight of film forming polymer (Makrolon resin).

The second column is the potential after exposure of 3.8 ergs/cm$^2$.

Depletion in the third column represents loss of potential during the charging step and is caused by free carriers from the pigment traversing the charge transport layer during the charging the step.

The fourth column represents one second dark decay in volts All numerical values in Table B indicate improvement. The stronger response of Batch 2 with respect to Batch 1 (Table A) should be noted.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. An electrophotographic imaging member comprising a charge generating layer comprising trigonal selenium particles and a charge transport layer, the charge transport layer comprising a protonic acid or Lewis acid, a charge transporting small molecule, a film forming polymer, and polyalkylene-block-polyethylene oxide.

2. An electrophotographic imaging member according to claim 1 wherein the film forming polymer is a polycarbonate.

3. An electrophotographic imaging member according to claim 1 wherein the charge transport layer comprises between about 10 ppm and about 150 ppm by weight of polyalkylene-block-polyethylene oxide, based on the weight of the film forming polymer.

4. An electrophotographic imaging member according to claim 1 wherein the charge transport layer is formed from a coating solution comprising the acid, charge transporting small molecule, film forming polymer, polyalkylene-block-polyethylene oxide and a solvent, the solvent comprising methylene chloride and the acid comprising 5 ppm and about 20 ppm by weight of trifluoroacetic acid, based on the weight of the solvent.

5. An electrophotographic imaging member according to claim 1 wherein the charge transport layer comprises between about 30 and about 60 percent by weight of the charge transporting small molecule, based on the total weight of the dried charge transport layer.

6. An electrophotographic imaging member according to claim 1 wherein the charge transporting small molecule comprises an aromatic amine compound.

7. An electrophotographic imaging member according to claim 1 wherein the charge transport layer comprises between about 40 and about 70 percent by weight of the film forming binder, based on the total weight of the dried charge transport layer.

8. An electrophotographic imaging member according to claim 1 wherein the polyalkylene-block-polyethylene oxide is represented by the formula:

$$A—B \quad (I)$$

wherein A is represented by the formula:

$$CH_3(\overset{R}{\overset{|}{C}}H\overset{R_1}{\overset{|}{C}}H)_X— \quad (IA)$$

wherein

R and $R_1$ are independently selected from hydrogen and an alkyl group having 1 to about 10 carbon atoms; and x is a number of 1 to about 142 and B is represented by the formula:

$$—CH_2O(CH_2\overset{R_2}{\overset{|}{C}}HO)_YH \quad (IB)$$

wherein $R_2$ is selected from the group consisting of hydrogen and an alkyl group having 1 to about 5 carbon atoms, and y is a number of from about 2 to about 817.

9. An electrophotographic imaging member according to claim 1 wherein the charge transporting layer comprises at least about 10 ppm polyalkylene-block-polyethylene oxide, based on the weight of the film forming polymer.

10. A process for fabricating an electrophotographic imaging member comprising providing a charge generating layer comprising trigonal selenium particles, forming a charge transporting layer coating composition to the charge generating layer, the coating composition comprising a charge generating layer and a charge transport layer, the charge transport layer comprising a protonic acid or Lewis acid, a charge transporting small molecule, a film forming polymer, solvent, and polyalkylene-block-polyethylene oxide, and drying the coating to form a charge transporting layer.

11. A process for fabricating an electrophotographic imaging member according to claim 10 wherein charge transporting layer coating composition comprises between about 40 ppm and about 150 ppm of the polyalkylene-block-polyethylene oxide, based on the weight of the film forming polymer.

12. A process for fabricating an electrophotographic imaging member according to claim 11 wherein charge transporting layer coating composition comprises at least about 10 ppm of the polyalkylene-block-polyethylene oxide, based on the weight of the film forming polymer.

13. A process for fabricating an electrophotographic imaging member according to claim 11 wherein the acid in the charge transporting layer coating composition comprises at least about 5 ppm of the trifluoroacetic acid, based on the weight of the solvent.

14. A process for fabricating an electrophotographic imaging member according to claim 13 wherein charge transporting layer coating composition comprises between about 5 ppm and about 20 ppm of the trifluoroacetic acid, based on the weight of the solvent.

15. A process for fabricating an electrophotographic imaging member according to claim 10 wherein the polyalkylene-block-polyethylene oxide is represented by the formula:

$$A—B \quad (I)$$

wherein A is represented by the formula:

$$CH_3(\overset{R}{\overset{|}{C}}H\overset{R_1}{\overset{|}{C}}H)_X— \quad (IA)$$

wherein

R and $R_1$ are independently selected from hydrogen and an alkyl group having 1 to about 10 carbon atoms; and x is a number of 1 to about 142 and B is represented by the formula:

$$—CH_2O(CH_2\overset{R_2}{\overset{|}{C}}HO)_YH \quad (IB)$$

wherein $R_2$ is selected from the group consisting of hydrogen and an alkyl group having 1 to about 5 carbon atoms, and y is a number of from about 2 to about 817.

* * * * *